US005535254A

United States Patent [19]

Carlson

[11] Patent Number: 5,535,254

[45] Date of Patent: Jul. 9, 1996

[54] X-RAY TUBE WITH SELF-BIASING DECK

[76] Inventor: Todd R. Carlson, 4516 Lilac Ave., Glenview, Ill. 60025

[21] Appl. No.: 443,288

[22] Filed: May 17, 1995

[51] Int. Cl.[6] ..... H01J 35/14

[52] U.S. Cl. ..... 378/113; 378/138

[58] Field of Search ..... 378/113, 38

[56] References Cited

U.S. PATENT DOCUMENTS 4,559,640 12/1985 Le Guen et al. ..... 378/113

5,007,074 4/1991 Furbee et al. ..... 378/138

*Primary Examiner*—Craig E. Church

*Attorney, Agent, or Firm*—Bella Fishman

[57] ABSTRACT

A self-biased focus X-ray generating tube has a cathode assembly connected by its insert end to a multiplier from outside a vacuum envelope. The multiplier rectifies and multiplies AC power of the filament drive to provide a DC voltage, which is applied to the cathode assembly for pinching the electron beam traveling between the cathode and the anode target of X-ray tube and, as a result, improving the quality of the focal spot.

8 Claims, 3 Drawing Sheets

X-RAY TUBE WITH SELF-BIASING DECK

FIELD OF THE INVENTION

The present invention relates to X-ray tube technology, and more particularly to a bias voltage supply for improving the radiological quality of the focal spot of electrons bombarding the anode of an X-ray tube.

BACKGROUND OF THE INVENTION

In X-ray generating tube for medical applications, a stream of electrons emitted from a cathode and accelerated to high energy in an evacuated envelope strikes an anode target to release electromagnetic energy in the form of X-rays. The tube envelope comprises a window transparent to X-rays so that radiation passes through the window to a patient undergoing examination or treatment.

In many applications, it is desirable to narrowly focus a stream of electrons onto a small area of the anode target, known as the "focal spot". Only a small fraction of the electron energy is converted to X-rays, while most of the electron energy is converted directly to heat energy. Some electrons have enough kinetic energy to leave the anode target and fly off in random directions. These electrons, still subject to the high voltage field, tend to be reabsorbed back into the anode target or any other surface which intercepts their course. These electrons are known as "secondary or stray" electrons as opposed to the electrons in the primary stream from the cathode.

Secondary electrons cause not only undesirable heating of the tube envelope near the focal spot area, but create a so called, "off focal radiation". Off focal radiation produced by secondary electrons creates a background radiation pattern which damages the quality of an X-ray image by increasing the size of the focal spot of the X-ray tube and leading to the geometric blurring.

One approach to control the size of the focal spot of the electron stream on the anode target has been to mount a cathode filament to a focusing support member. In a conventional tube design a cathode usually comprises one or few electrically energized filaments. The filament is mounted into a cup-shaped electrode surrounding the filament on its side opposed to the one facing the anode target. In order to control the size of the focal spot being formed by an electron beam on the anode target, electrical bias voltage has been applied between the cup-shaped electrode and the filament. The cup electrode has operated at cathode potential and was biased negatively when electron beam cut-off has been required.

The improvement of this design and attempt to minimized the size of the focal spot for obtaining a high resolution images resulted in a system which had a second electrode interposed between the cup electrode and anode target. The second electrode was connected to a variable, independent from the cathode, voltage supply. Though these systems provided some improvement in adjusting the focal spot, the use of the independent source for electrode bias voltage brought about undesirable and unpredictable changes in the focusing regulations connected with power line fluctuations and other transients during X-ray exposures.

One attempt to cure this problem by designing the bias voltage circuit for the focusing electrode between the cathode and the ground so that any variations in the cathode voltage would vary the bias voltage in the same proportion did not give the significant improvement in minimizing the focal spot size, while made the tube susceptible to failure due to a high voltage transience.

Different approach to address these problems has been made by Furbee, et al. in the U.S. Pat. No. 5,007,074 entitled, "X-RAY TUBE ANODE FOCUSING BY LOW VOLTAGE BIAS". According to this invention, the cathode cup is battery biased at a low voltage in order to reduce the dispersion of the electron beam which causes the wings on the anode target focal spot. A small, self-contained battery is introduced in the tube between the X-ray tube envelope and the housing, and is used as a bias voltage source. Although satisfactory in certain respects, such a system suffers from disadvantages. The battery will deplete over time and will change its output value over a temperature range conventional to the tube housing. This change will be inversely proportional to the desired optimum value, while the battery bias will remain unchangeable in spite of the changes in the power of the tube.

SUMMARY OF THE INVENTION

It is therefore an object of the present invention to provide a focal spot self-biasing X-ray tube design which allows to optimize the projected geometry of the focal spot for enhancing the resolution and increasing the power density in the focal spot.

The present invention addresses the problem by electrical means which biasing the cathode cup of the X-ray tube by deriving the power from the filament signal.

In accordance with the present invention, an X-ray tube is provided comprising a housing with a vacuum envelope positioned within the housing and having rotating anode target and cathode assembly disposed therein. The cathode assembly having at least one filament mounted in a cup-shaped electrode to focus an electron beam which is generated by the cathode and accelerated by a high voltage applied between the anode target and the cathode assembly. An AC source is included to provide heating of the filament to the temperature required for thermal emission. A self-biasing deck is mounted outside the vacuum envelope in proximity to the cathode assembly. The self-biasing deck comprising a voltage multipier which electrically connected between the AC source and the cup-shaped electron of the cathode assembly for applying a DC bias voltage. Such an arrangement controls a geometry of the focal spot on a surface of the anode target The above and still further objects, features and advantages of the present invention will become apparent upon consideration of the following detailed description of the specific embodiment, when taken in conjunction with the accompanying drawings.

DESCRIPTION OF THE PREFERRED EMBODIMENTS

Figure 2:
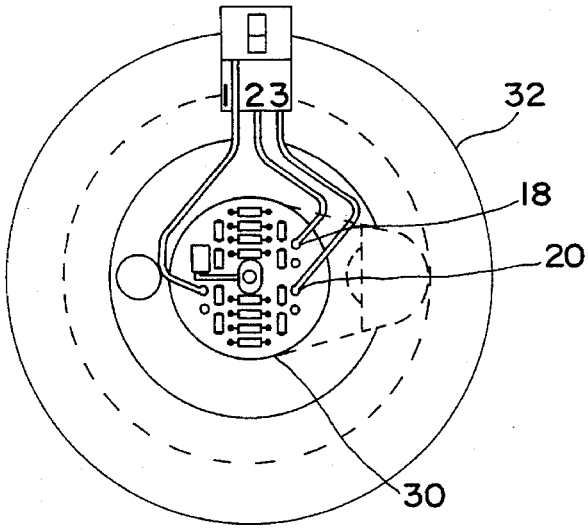
FIG. 2 is a cross sectional view of a self-bias deck which supplies a bias voltage from a AC voltage source to an inset of the X-ray tube.
Figure 1:
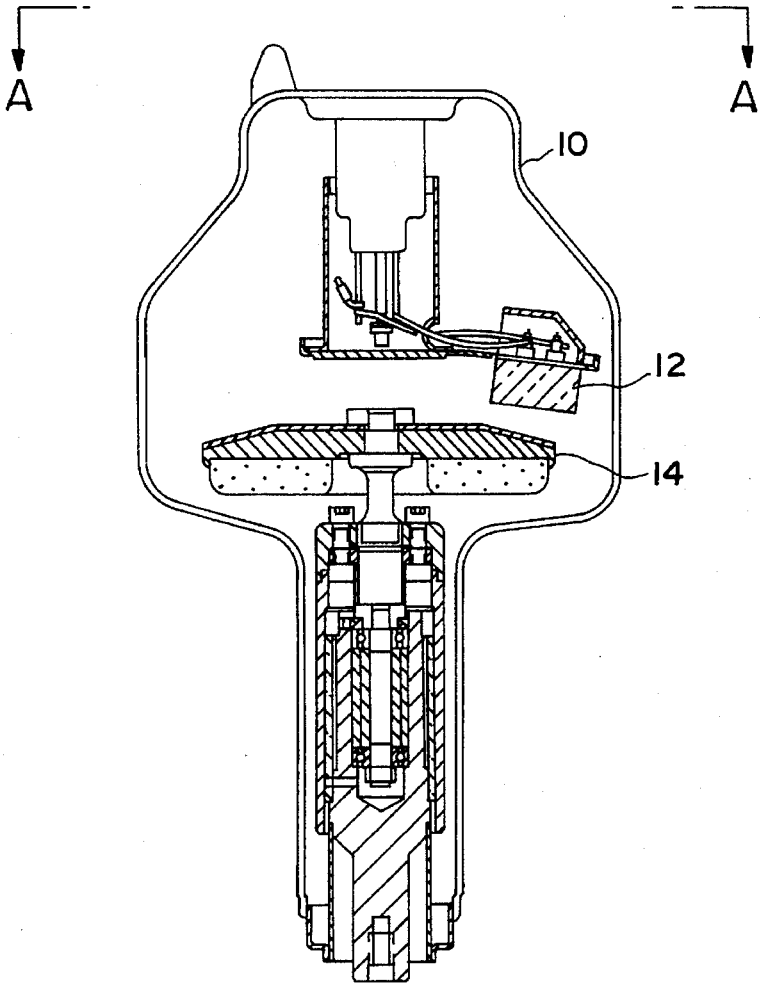
FIG. 1 is a cross sectional view of the X-ray-generating tube which incorporates the present invention.
Figure 3:
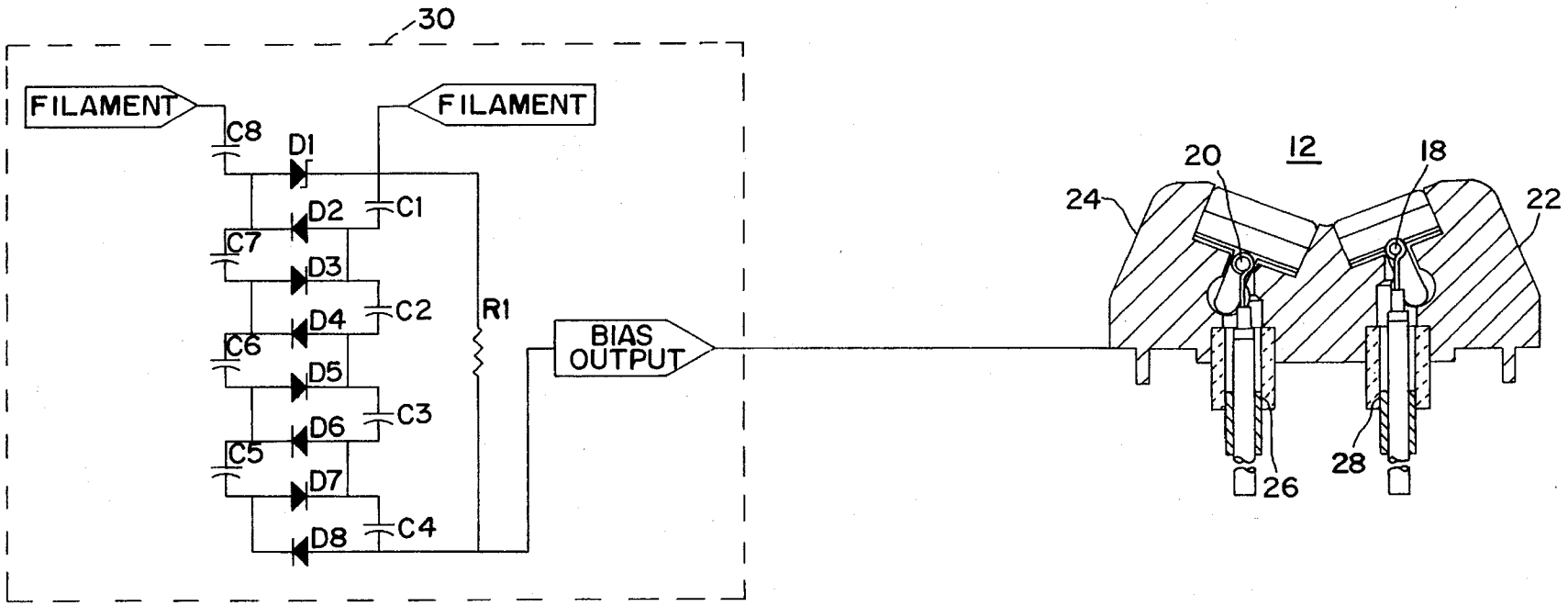
FIG. 3 is a cathode assembly of the X-ray tube which incorporates the present invention.
Figure 4:
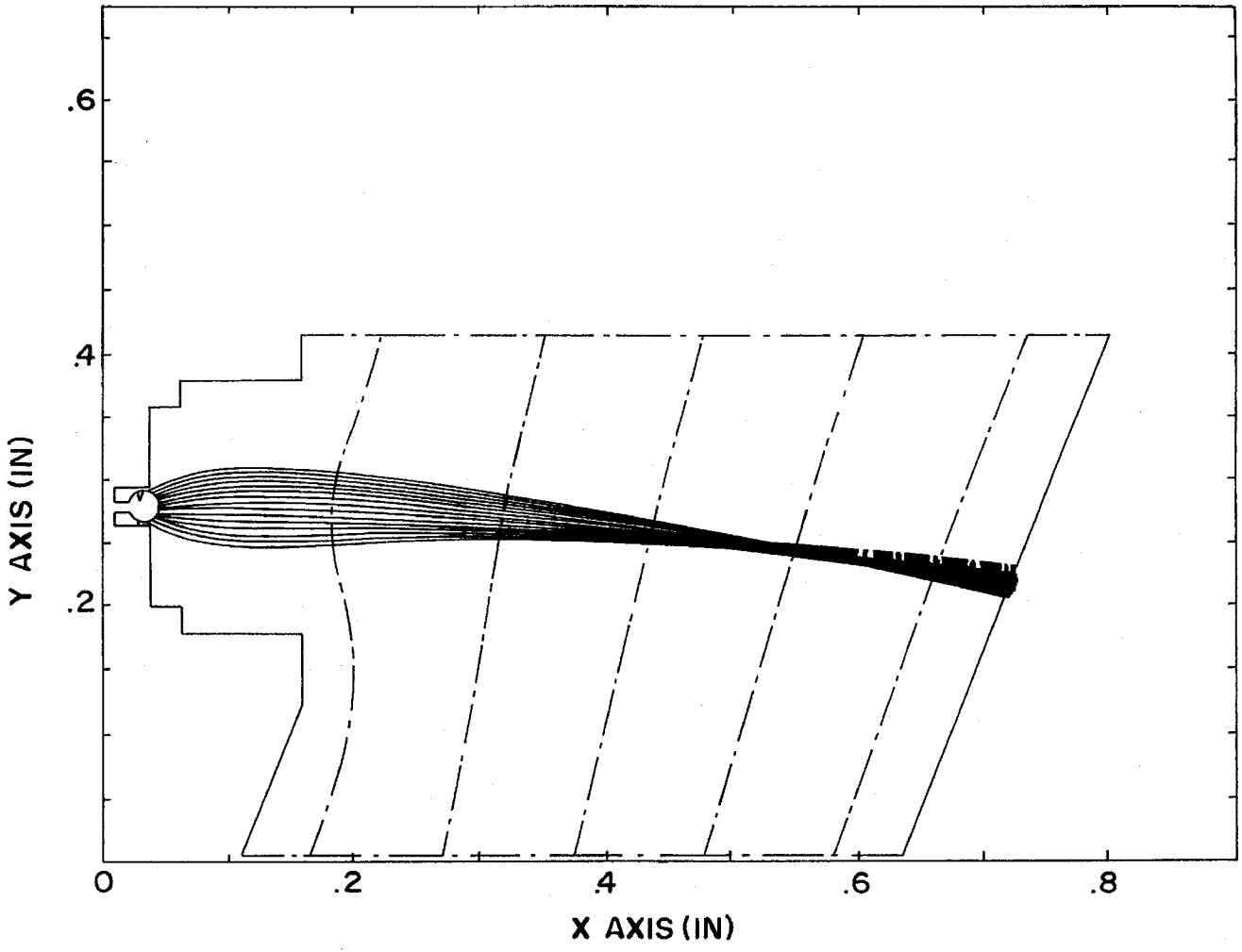
FIG. 4 is a focal spot plot obtained from X-ray generating tube which incorporates the present invention.

FIG. 1 and 2 schematically show an X-ray generating tube embodying the present invention. Vacuum envelope 10 houses the internal structure of the tube. Stationary cathode assembly 12 for emitting a stream of electrons is disposed in proximity to rotating anode target 14. Electrons emitted from cathode assembly 12 are directed to the surface of anode target 14. The electrons are formed into a narrow, uniform stream by focus cups of cathode assembly 12 as it can be seen on the plot of FIG. 4. The electron stream is accelerated to high energy by the voltage difference between the anode target and the cathode. The high voltage being applied between the cathode assembly and anode target is derived from a DC power supply through power supply connectors. During an X-ray exposure, the anode target is held at the ground potential or above the ground potential while the cathode assembly is held below the ground potential. Referring to FIG. 3, cathode assembly 12 comprises a pair of filaments 18 and 20, each mounted to respective focus cups 22 and 24 via respective ceramic insulators 26 and 28. AC Source (not shown) is coupled in a conventional way to filaments 18 and 20 to provide about 4–10 volts to the filaments to heat the filament coil to the temperature required for thermal emission. The filaments are heated from a filament power transformer providing the filament voltage at 75 kV below ground. Self-biasing circuit 30 is connected between the filament power source and focus cup of the cathode assembly, and is positioned on deck 32, plane view of which shown in FIG.2. Deck 32 is mounted directly to the insert of X-ray tube outside of vacuum envelope 10 shown in FIG. 1. The input signal to drive biasing circuit 30 is pulled from the filament power transformer. The input power is in the order of 0.05 milliwatts. This input AC voltage applies to a voltage multiplier of biasing circuit 30. The voltage multiplier designed of diodes and capacitors and is used of the type known as the Cockcroff-Walton type to produce low DC voltage in the range of about 24–40 volts from an alternating current source. In FIG. 3, an eight stage multiplier is shown. The number of stages is optional. The multiplier produces a voltage approximately eight times higher than the voltage of the filament signal. In the preferred embodiment, eight capacitors 10 μF each, and eight diodes of the type IN914 have been used.

Biasing circuit 30 produces a level of bias that is proportional to the amplitude of the filaments signal. When more anode target current is required a higher level of bias will be produced since higher target current requires raising the filament voltage. By applying a negative charge with respect to the common leg of the filament on the electrically isolated focus cup, this bias charge will repel and force back into the middle of the beam stray or secondary electrons which produce shadows or wings on the width of a focal spot detracting from the quality of the images. By selecting the proper level of bias the wings are eliminated without pinching off the beam to the point where the filament needs to be driven harder. The incorporation of the focal spot self-biasing deck in the X-ray robe design allows for corrections to the focal spot geometry and density and such corrections can be done external to the tube without increasing power requirements on either the filament power supply or presenting a potential problem in the high voltage supply of the tube.

What is claimed is:

1. An X-ray tube comprising:

a vacuum envelope;

a rotating anode target placed within said envelope;

a cathode assembly placed within said envelope for generating a beam of electrons to strike a surface of said anode target facing said cathode assembly, said cathode assembly having at least one filament mounted in a cup-shaped electrode to focus said electron beam and form a focal spot on said surface of said anode target;

a high voltage source for maintaining a potential between said anode target and said cathode assembly to cause said electron beam to strike said anode target with sufficient energy to generate X-rays;

an AC source coupled to said filaments to provide heating of said filament to the temperature required for thermal emissions;

a self-biasing deck having a voltage multiplier, said deck mounted outside said vacuum envelope in proximity to said cathode assembly, said voltage multiplier electrically connected between said AC source and said cup-shaped electrodes for applying a DC bias voltage to control a geometry of said focal spot on said surface of said anode target.

2. The X-ray tube of claim 1, wherein said AC source is a filament isolation transformer, said transformer provides the voltage of about 75 kV below ground.

3. The X-ray tube of claim 2, wherein said voltage multiplier is a Cockroff-Walton type.

4. The X-ray tube of claim 3, wherein said voltage multiplier comprises preferably eight stages.

5. The X-ray tube of claim 4, wherein said voltage multiplier is placed on a biasing deck.

6. A self-biased focus X-ray generating tube comprising:

a housing;

a vacuum envelope mounted within said housing, said envelope comprising a cathode assembly with a filament placed into a cup-shaped electrodes for emitting electrons and forming an electron beam, and an anode target for receiving said electron beam, forming a focal spot on a surface facing said cathode assembly and for emitting an X-ray beam therefrom;

an AC source for supplying heating current to said filament;

a biasing source placed between said housing and said envelope and mounted on an insert of said envelope in proximity to said cathode assembly for supplying a low DC bias voltage from said AC source to said cup-shaped electrode, said biasing source comprising a Cockroff-Walton type voltage multiplier.

7. The self-biasing focus X-ray generator tube of claim 6, wherein said low DC bias voltage is in the order of about 24–40 volts.

8. The self-biased focus X-ray generator tube of claim 6, wherein said voltage multiplier comprises preferably eight capacitors and eight diodes.

* * * * *